United States Patent [19]

Marra

[11] 4,249,507

[45] Feb. 10, 1981

[54] POWER BOWSTRING RELEASE DEVICE

[76] Inventor: Paul Marra, 8 Eventide Pl., Levittown, Pa. 19054

[21] Appl. No.: 20,350

[22] Filed: Mar. 14, 1979

[51] Int. Cl.[3] ..... F41B 5/00

[52] U.S. Cl. ..... 124/35 A

[58] Field of Search ..... 124/35 A, 24 R, 23 R, 124/22, 41 A

[56] References Cited

U.S. PATENT DOCUMENTS

| | | | |
|---|---|---|---|
| 2,982,279 | 5/1961 | Pursley | 124/35 A |
| 3,937,206 | 2/1976 | Wilson | 124/35 A |
| 4,004,564 | 1/1977 | Castonguag | 124/35 A |
| 4,009,703 | 3/1977 | Cunningham | 124/35 A |
| 4,062,339 | 12/1977 | Wilson | 124/35 A |
| 4,173,210 | 11/1979 | Napier | 124/35 A |

*Primary Examiner*—Richard C. Pinkham
*Assistant Examiner*—William R. Browne
*Attorney, Agent, or Firm*—Stanley B. Kita

[57] ABSTRACT

A bowstring draw and release device has a frame in which a hammer is mounted in such a way as to cooperate with a trigger and latch to effect release of the bowstring with a relatively low trigger pressure. The device includes a frame having a recess in its front end and a pivotal latch member adapted to extend across the recess for engaging a loop which is formed into a bight around the bowstring. The latch is tripped to afford offslipping of the loop and hence release of the bowstring and arrow engaged therewith. A latch sear is releasably engaged with the latch and has a portion disposed in the path of movement of a spring biased hammer normally held in a cocked position by a hammer sear connected to the trigger. A suitable handgrip extends rearwardly from the frame and is designed to enable the user to actuate the trigger with his index finger. Rearward pull on the trigger causes the hammer sear to disengage the hammer and release it from the cocked position, whereby the hammer advances forwardly to engage and pivot the latch sear for causing it to disengage the latch, thereby causing the latch to pivot forwardly to release the loop and thereby afford offslipping of the loop from the bowstring and hence release of the arrow knocked therewith.

10 Claims, 6 Drawing Figures

POWER BOWSTRING RELEASE DEVICE

FIELD OF THE INVENTION

The present invention relates to archery equipment; more particularly, the present invention relates to bowstring draw and release devices.

BACKGROUND OF THE INVENTION

Various devices are known to assist an archer in drawing a bowstring with a knocked arrow. Such devices normally include either a flexible or a rigid member adapted to engage the bowstring in the vicinity of the arrow knock, a latch for normally restraining the string restraining member, and an actuator which functions to release the string restraining member. Examples of such devices may be found in the following U.S. Pat. Nos.: 4,009,703; 3,916,868; 3,954,095; 3,847,133; 3,845,752; 4,062,339; 4,083,348; 3,952,720; 3,461,852; 3,788,299; 2,926,650; and 1,469,610.

Although the various commercially available bowstring release devices may function satisfactorily for their intended purpose, most have a common limitation in that the pressure required to actuate them is related to the tension on the bowstring. In other words, the higher the tension on the bowstring, the greater the force required to actuate the release device. If the pressure varies with bowstring tension, and/or the pressure required to actuate the device is too great, shooting accuracy may be impaired because the archer's concentration may be diverted from aiming when actuating the device.

U.S. Pat. No. 2,965,093 discloses a bowstring arow and release device having a spring-loaded latch release mechanism with a pivotally-movable hammer. Although this device may function satisfactorily, it is relatively complicated. Also, the device requires thumb pressure to actuate and is, therefore, not as natural for an archer to use as a bowstring release device which can be operated by an archer's index or "trigger" finger to release the bowstring independently of the tension on the bowstring.

OBJECTS OF THE INVENTION

With the foregoing in mind, a primary object of the present invention is to provide an improved bowstring release device which enables an archer to shoot accurately.

It is another object of the present invention to provide a novel bowstring release device which requires the same actuating force to effect release of the bowstring irrespective of tension on the bowstring.

As a further object, the present invention provides a unique bowstring draw and release device having an adjustable trigger setting to enable the device to have a sensitive hair trigger.

A still further object of the present invention is to provide a power-actuated bowstring draw and release device wherein the arrangement of elements is such that the reaction forces produced by the power actuator are directed in substantial alignment with the bowstring so as to minimize interference of such forces with proper release of the bowstring and hence shooting accuracy.

SUMMARY OF THE INVENTION

As a more specific object, the present invention comprises a frame having a front end with a recess and a latch member pivotally mounted with respect to the recess so as to extend across the recess for engaging a flexible loop after the loop has been formed into a bight around a bowstring. A latch sear has a lower end which is spring loaded upwardly into engagement with the lower end of the latch, and the latch sear has an upper end projecting upwardly into the path of movement of a hammer mounted in the frame for movement longitudinally from a cocked position spaced rearwardly from the latch sear. The hammer is powered by means of a compression spring interposed between it and the rear of the frame, and the hammer is placed in its cocked position by means of a bolt extending laterally through an elongated slot in the frame. The hammer is retained in its cocked position by means of a hammer sear which normally engages the front of the hammer but which is connected to the trigger which, when pulled, displaces the hammer sear laterally of the hammer to effect its release. An adjusting cam surface is provided on the trigger, and a set screw is provided on the frame for adjusting the sensitivity of the trigger. A hand grip extends rearwardly from the frame to enable an archer to grip the same in such a manner as to afford actuation of the trigger with his index finger.

In operation, the loop is formed around the bowstring and engaged with the latch in the recess, and the hammer bolt is pulled rearwardly to cause the hammer sear to engage the front of the hammer and thereby to cock the same. After the bowstring has been drawn and the archer has taken aim on a target, he squeezes the trigger. Trigger movement causes the hammer sear to release the hammer enabling it to travel forwardly under the influence of the compression spring to engage the upper end of the latch sear. This, in turn, pivots the latch sear causing it to disengage the lower end of the latch enabling the bowstring to cause the latch to pivot forwardly affording offslipping of the loop from the latch and the bowstring.

BRIEF DESCRIPTION OF THE DRAWINGS

These and other objects, features, and advantages of the present invention should become apparent from the following description when taken in conjunction with the accompanying drawings, in which.

DESCRIPTION OF PREFERRED EMBODIMENT

Figure 1:
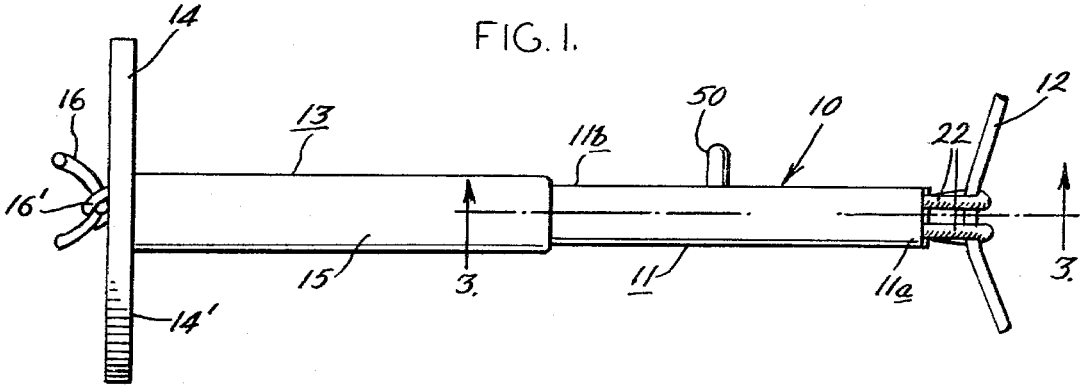
FIG. 1 is a plan view of a power bowstring draw and release device which embodies the present invention.

Referring now to the drawings, FIG. 1 illustrates a power bowstring draw and release device 10 which embodies the present invention. As best seen therein, the device 10 comprises an elongated frame means 11 having a front end 11*a* adapted to be placed adjacent a bowstring 12 and a rear end 11*b* which carries means providing a hand grip 13. The hand grip 13 includes a circular plate 14 disposed transversely across the rear end of a resilient tubular member 15 extending rearwardly from the rear end 11*b* of the frame 11. The hand grip 13 is fastened to the frame 11 by means of a cord 16 which passes through a rearwardly protruding yoke 17 threaded into the rear end 11*b* of the frame 11, longitudinally along the inside of the tubular member 15, and through a pair of holes (not shown) in the plate 14, after which the cord 16 is tied into a knot 16'. The tubular member 15 is resilient and is of sufficient length as to be capable of being gripped in the palm of an archer's hand so that the heal of his hand is against the front face 14' of the plate 14 and his index finger is located ahead of trigger means 20 which depends from the frame 11.

According to the present invention, the bowstring draw and release device 10 is designed to operate independent of the tension on the bowstring 12 to afford release of the bowstring 12 and the arrow knocked therewith (not shown) by a pull on the trigger 20. To this end, means is provided in the frame 11 for storing mechanical energy and for cooperating with the trigger 20 to release the energy to effect release of the bowstring 12. As a result, release of the bowstring 12 and the arrow occurs without any conscious increased trigger pull effort on the part of the archer, and this enables him to concentrate more on aiming. As a result, the archer is able to improve the accuracy of his shooting.

Figure 3:
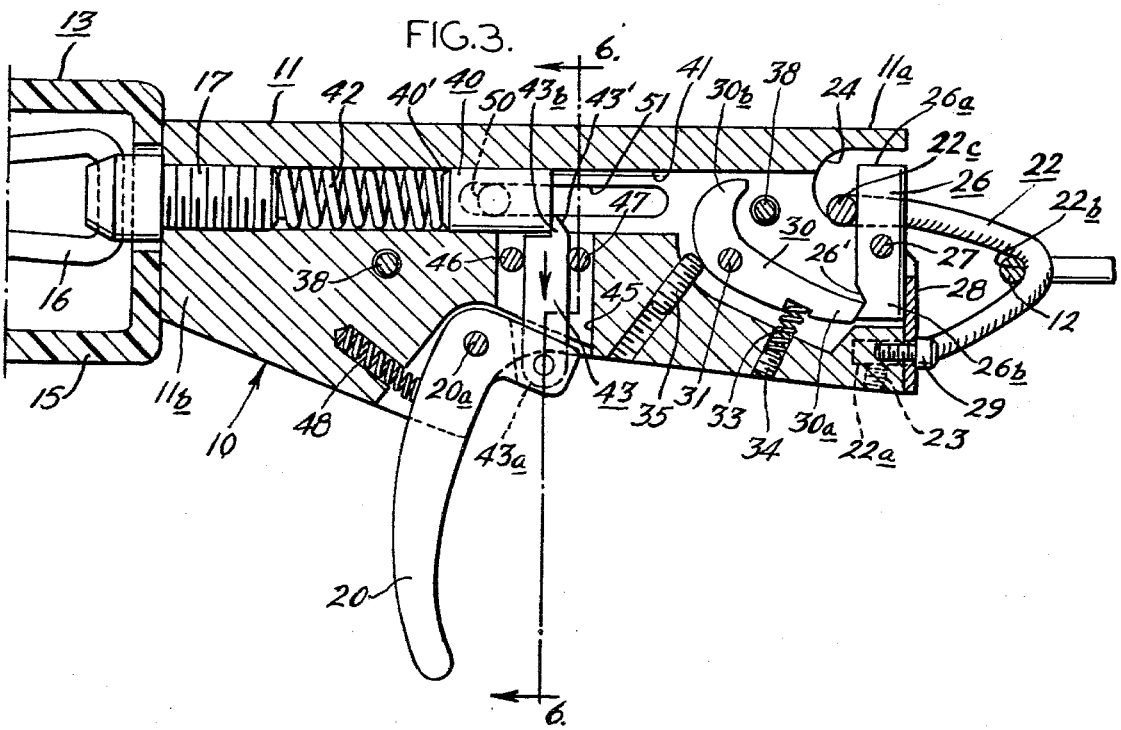
FIG. 3 is an enlarged fragmentary sectional view taken on line 3—3 of FIG. 1 to illustrate the device cocked in its bowstring draw position.

Referring now to FIG. 3, the bowstring 12 is secured to the front 11*a* of the frame 11 by means of a strong loop of a cord 22 which has both of its free ends 22*a* received in forwardly opening bores in the front end 11*a* of the frame 11 and held in the bores by means of set screws 23 threaded upwardly in the underside of the front end 11*a* of the frame 11. The loop 22 forms a bight 22*b* around the bowstring 12 and has a return bend 22*c* which is received in a recess 24 in the front end 11*a* of the frame 11.

Figure 2:
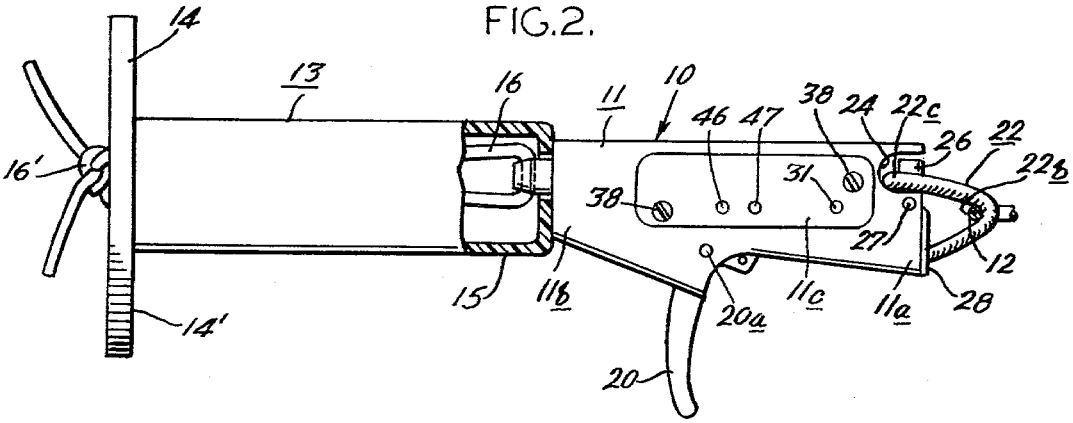
FIG. 2 is a side elevational view thereof.

In order to retain the cord loop 22 in the position illustrated in FIGS. 2 and 3, and to release the same when desired, latch means 26 is pivotally mounted at the front end 11*a* of the frame 11 adjacent the recess 24. In the illustrated embodiment, the latch means 26 includes a cylindrical member having an upper end 26*a* extending substantially completely across the width of the recess 24 and adapted to pass through the cord loop 22 and to engage the return bend 22*c* in the manner illustrated in FIGS. 2 and 3. A pivot pin 27 extends transversely across the frame 11*a* below the recess 24 to enable the latch member 26 to pivot alternately in the clockwise and counterclockwise directions. The latch member 26 has a lower end 26*b* which is disposed below the pivot pin 27 and which is adapted to engage the inside of an abutment plate 28 fastened to the front of the frame by means of a cap screw 29. The abutment plate 28 limits the pivotal movement of the latch member 26 in the counterclockwise direction about its pin 27.

The latch member 26 is normally retained in its operative position with upper end 26*a* extending across the recess 24 by means of a latch sear 30. The latch sear 30 is mounted to pivot about a pin 31 extending across the frame 11 rearwardly of the latch pivot pin 27. The latch sear 30 has a lower end 30*a* which releasably engages in a detent 26' in the lower end 26*b* of the latch member 26. The lower end of the latch sear 30*a* is normally urged upwardly into engagement with the detent 26' by means of a compression spring 33 having its upper end engaged in a notch in the lower end 30*a* of the latch sear and having its lower end engaged in a hole in the frame 11 closed by a set screw 34 threaded upwardly into the bottom of the frame 11 in the manner illustrated in FIG. 3. Thus, it may be seen that when the latch sear 30 is disposed in the manner illustrated in FIG. 3, the upper end 26*a* of the latch member 26 is restrained against pivotal movement in the clockwise direction, and this enables the cord 22 to apply tension to the bowstring 12 in the manner illustrated in FIG. 1 as when the bowstring 12 is drawn. The bowstring 12 is released when the latch member 26 pivots clockwise about its pivot pin 27 into its position generally parallel with the recess 24 and in the longitudinal direction of the frame 11.

To release the latch member 26, the latch sear 30 has an upper end 30*b* which projects upwardly above its pivot pin 31 and which is operable when displaced forwardly to pivot the latch sear 30 clockwise for causing its lower end 30*a* to disengage the detent 26' in the lower end 26*b* of the latch member 26. The amount of engagement of the lower end of the latch sear 30 with the latch member 26 is regulated by means of an adjustment screw 35 which is threaded upwardly into the bottom of the frame 11 and which engages the latch sear 30 at a location so as to cause the latch sear 30 to pivot clockwise when the set screw 35 is turned inwardly. The set screw 35 also functions to provide a limit to the counterclockwise pivotal movement of the latch sear 30 and thereby can provide a preload on the latch sear spring 34 while at the same time functioning to maintain the latch sear spring 34 properly engaged with the latch sear 30. An abutment screw 38 extends transversely across the frame in front of the upper end 30*b* of the latch sear 30 to limit the pivotal movement of the latch sear 30 in the clockwise direction.

For the purpose of pivoting the latch sear 30 clockwise, and hence affording clockwise pivotal movement of the latch member 26 to release the bowstring 12, hammer means 40 is mounted in the frame 11 for movement longitudinally from a cocked position spaced rearwardly from the upper end 30*b* of the latch sear 30 as seen in FIG. 3 to a position engaged with the upper end 30*b* of the latch sear 30. In the present instance, the hammer means 40 has a generally cylindrical shape and is received in a cylindrical bore 41 extending lengthwise in the frame 11 in substantial alignment with the upper end 26*a* of the latch member 26. A compression spring 42 is interposed between the rear end of the hammer 40 and the inner end of the yoke 17 at the rear end 11*b* of the frame 11. The hammer 40 is retained in its cocked position as illustrated in FIG. 3 by means of a hammer sear 43 mounted for movement in the frame 11 transversely to the path of movement of the hammer 40 in the direction indicated by the arrow in FIG. 3. The hammer sear 43 has a lower end 43*a* which is pivotally connected to the trigger 20 ahead of its frame pivot pin 20*a*, and the hammer sear 43 has an upper end 43*b* adapted to releasably engage the front end of the hammer 40 in a manner illustrated in FIG. 3. The hammer sear 43 moves vertically and pivotally in a slot 45 projecting upwardly from the bottom of the frame 11, and a pair of guide pins 46 and 47 extend transversely across the slot 45 to engage the hammer sear 43 for constraining it from movement in the slot 45. The front guide pin 47 bears against the front of the hammer sear 43 to restrain it against the force of the compression spring 42 acting against the hammer 40.

The hammer sear 43 is urged upwardly so as normally to be disposed in the path of movement of the hammer 40 by means of a compression spring 48. As best seen in FIG. 3, the compression spring 48 is received in a downward protrusion on the underside of the frame 11 in a bore therein. The compression spring 48 engages the rear of the trigger 20 to bias the same counterclockwise about its pivot pin 20*a* for urging the hammer sear 43 upwardly to normally engage the front face of the hammer 40.

In order to displace the hammer 40 into its cocked position, cocking means is provided. In the present instance, the cocking means includes a handle 50 which is connected to the hammer 40 and which projects laterally through an elongated slot 51 in the side of the frame 11. The rear face of the hammer 40 has a cam surface 40' which cooperates with a cam surface 43' on the upper end 43*b* of the hammer sear 43 to displace the hammer sear 43 downwardly when the hammer 40 is pulled rearwardly by means of the handle 50.

Figure 5:
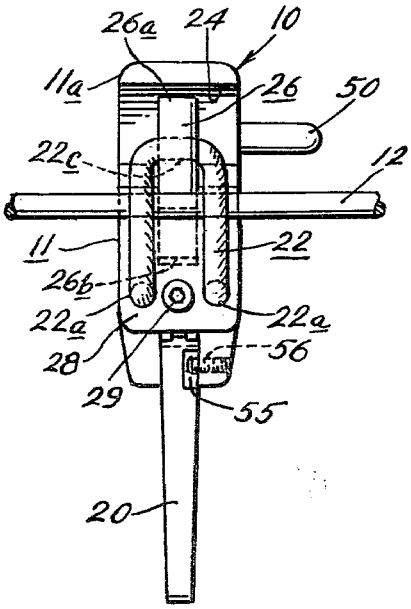
FIG. 5 is a front elevational view of the device in operative engagement with a bowstring.

According to another aspect of the present invention, means is provided to adjust the sensitivity of the trigger 20. To this end, and as best seen in FIG. 5, the trigger sensitivity adjustment means includes a cam surface 55 provided on the front of the upper end of the trigger 20 for cooperating with an adjustment set screw 56 threaded laterally into the lower end of the frame 11 and adapted to engage the cam surface in the manner illustrated in FIG. 5. Rotation of the set screw 56 inwardly causes the trigger to be displaced rearwardly and moves the upper end 43*b* of the hammer sear 43 downwardly along the front face of the hammer 40. As a result, the amount of engagement of the upper end 43*b* of the hammer sear 43 with the front face of the hammer 40 can be adjusted in such a manner as to enable the device 10 to release the bowstring 12 with a minimum amount of trigger movement.

Figure 6:
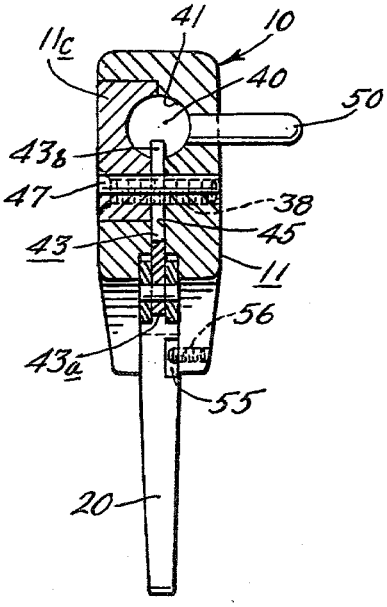
FIG. 6 is a sectional view taken on line 6—6 of FIG. 3.

In order to afford assembly of the various parts in the appropriately provided recesses and cavities in the frame 11, a frame plate 11*c* is provided. As best seen in FIGS. 2 and 6, the frame plate 11*c* is held in position by a pair of screws 38 which extend transversely across the frame 11, and the latch sear pivot pin 31 and the guide pins 46 and 47 for the hammer sear 43 have ends which are supported in the frame plate 11*c*. The inside of the frame is hollowed to accommodate the various parts and to afford appropriate movement thereof.

Figure 4:
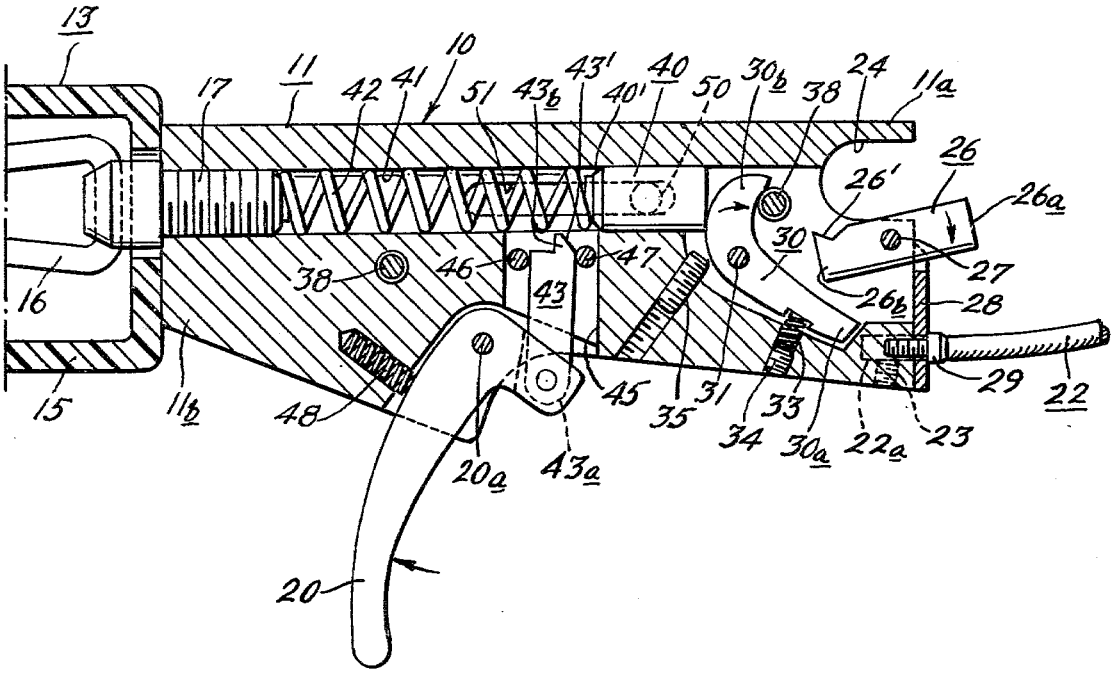
FIG. 4 is a sectional view similar to FIG. 3 but illustrating the device after having released the drawn bowstring.

In operation, and referring particularly to FIG. 4, the illustrated draw and release apparatus 10 is placed in use by forming the loop 22 into a bight around the bowstring 12 and placing the return bend 22*c* of the loop 22 in the recess 24. Thereafter, the latch member 26 is pivoted counterclockwise so that its upper end 26*a* extends through the loop 22 and across the recess 24 in the manner illustrated in FIG. 3. The hammer handle 50 is then pulled rearwardly into the cocked position illustrated in FIG. 3. The archer may then grip the handgrip 13, and with the heal of his hand positioned against the base plate 14, may pull rearwardly on the bowstring to draw the same and to aim the arrow in the customary manner.

After the arrow has been properly aimed, the archer squeezes the trigger 20 rearwardly. This causes the latch sear 43 to move downwardly out of engagement with the hammer 40 which, under the influence of the energy stored in the compression spring 42, moves forwardly at a rapid rate to engage the upper end 30*b* of the latch sear 30. This in turn causes the latch sear 30 to pivot clockwise about its pivot pin 31 and against the bias of the compression spring 33 to disengage the detent 26' in the lower end 26*b* of the latch 26. As a result, the tension applied by the bowstring to the loop 22 causes the upper end of the latch 26*a* to pivot rapidly in the clockwise direction, and this causes the return bend 22*c* of the loop 22 to slip off the latch member 26 and from around the bowstring as it advances forwardly toward the bow in the customary manner.

If desired, the hammer may be cocked prior to placement of the latch member 26 in its active position illustrated in FIG. 3, in which event the pivotal movement of the latch member 26 displaces the lower end of the latch sear 30*a* clockwise until the detent 26' of the latch member clears the lower end of the latch sear 40, whereupon the latch sear spring 43 pivots the latch sear 30 counterclockwise to cause its lower end 30*a* to engage the detent 26' and thereby retain the latch member 26 in its operative position.

From actual tests it has been determined that the maximum amount of force required to pull the trigger 20 to release the bowstring 12 is about 2.0 ounces. As noted heretofore, this force is the same irrespective of tension on the bowstring 12.

In view of the foregoing, it should be apparent that the present invention now provides an improved bowstring draw and release device which is relatively simple in construction and which functions to enable archers to increase the accuracy of their shots. The substantial alignment of the hammer with the latch balances internal driving forces within the frame so as to provide a minimum of interference with the action of the bowstring when the trigger is pulled.

While a preferred embodiment of the present invention has been described in detail, various modifications, alterations and changes may be made without departing from the spirit and scope of the present invention as defined in the appended claims.

I claim:

1. Bowstring draw and release apparatus comprising:

elongated frame means having a front end adapted to be positioned adjacent a bowstring and a rear end, hand grip means extending from said rear end and adapted to be gripped by a user's hand, a loop mounted at the front end of said frame and adapted to be formed into a bight around a bowstring, means providing a recess in said front end for receiving said loop after having been formed into said bight, latch means mounted in said frame to pivot from a latched position wherein one portion extends through said loop across said recess to an unlatched position alongside the recess for affording off-slipping of the loop from the latch thereby to release a bowstring, hammer means mounted in said frame for movement longitudinally from a cocked position adjacent the rear end of the frame into an operative position toward the front end of the frame, means for driving said hammer means toward the front end of the frame, cocking means for displacing said hammer means against its driving means into said cocked position, hammer sear means releasably engaging said hammer means for releasably retaining it in said cocked position, trigger means extending laterally of said frame in front of said hand grip means so as to be engageable by the user's index finger for cooperating with said hammer sear means to disengage the same from said hammer means upon displacement of said trigger means, and latch sear means for releasably retaining the latch means in its latched position and having an upper portion disposed in the path of movement of said hammer means so as to be operable when struck by the hammer means to disengage the latch means and afford pivotal movement thereof to effect release of a bowstring.

2. Apparatus according to claim 1 including means on said frame for cooperating with the trigger means to adjust the amount of trigger means displacement required to effect disengagement of said hammer sear.

3. Apparatus according to claim 2 wherein said trigger adjusting means includes a cam surface disposed on said trigger means in inclined relation relative to the path of movement of the trigger means and a set screw mounted in said frame and displaceable against said cam surface.

4. Apparatus according to claim 1 wherein said hammer means moves in a linear path between said ends of the frame and wherein said hammer driving means includes a compression spring interposed between said hammer means and the rear end of said frame, and said cocking means includes a slot in said frame and a handle protruding laterally from said hammer means through said slot for gripping by a user to displace the hammer means rearwardly for cocking the same.

5. Apparatus according to claim 4 wherein the recess in the frame is disposed in substantial alignment with the path of movement of the hammer means.

6. Apparatus according to claim 4 including means biasing said hammer sear means into the path of movement of said hammer means and cooperating cam surfaces on said hammer sear means and hammer means for displacing said hammer sear means laterally of said hammer means as said hammer means is moved into its cocked position.

7. Apparatus according to claim 6 wherein said hammer sear means is pivotally connected to said trigger means ahead of the trigger means pivot axis, and said hammer sear biasing means includes a spring carried in said frame and engaging behind said trigger means to urge the trigger means forwardly and hence the hammer sear means upwardly into said path of movement.

8. Apparatus according to claim 1 wherein said latch means has a lower end disposed below its pivot axis, and said latch sear means has an upper end disposed in the path of movement of said hammer means and has a lower end releasably engaged with the lower end of said latch means and shaped so as to clear the lower end of the latch means as it pivots away from said recess, whereby engagement by the hammer means with the upper end of the latch sear means causes it to pivot and to disengage the latch means, thereby affording forward pivotal movement of the upper end of the latch means and hence offslipping of a bowstring therefrom.

9. Apparatus according to claim 8 including abutment means engageable by said latch sear means to arrest forward motion of said hammer means after said latch sear means has been struck by said hammer means, means to bias the lower end of said latch sear means upwardly so as normally to engage the lower end of said latch means, and means providing an adjustable stop means operating against said latch sear means counter to said bias and to set the maximum amount of travel between the latch means and the latch sear means required to effect release of a bowstring.

10. Apparatus according to claim 1 wherein the loop engaging portion of said latch means and latch sear means are disposed in substantial alignment with the path of movement of the hammer means so that reaction forces on the hammer means and the frame act substantially normal to a bowstring when the trigger is pulled and the hammer means released.

* * * * *